United States Patent [19]

Tompkins

[11] Patent Number: 4,948,383

[45] Date of Patent: Aug. 14, 1990

[54] ELECTRICAL CLAMP

[76] Inventor: Laramie W. Tompkins, 1004 W. County Line Rd., Royse City, Tex. 75089

[21] Appl. No.: 406,160

[22] Filed: Sep. 12, 1989

[51] Int. Cl.[5] ..... H01R 4/48

[52] U.S. Cl. ..... 439/759; 439/141; 439/755

[58] Field of Search ..... 439/754–756, 439/759, 506, 140, 141, 202

[56] References Cited

U.S. PATENT DOCUMENTS

| | | | |
|---|---|---|---|
| 1,975,896 | 10/1934 | Griffith et al. | 173/259 |
| 2,168,250 | 8/1939 | Toiberg et al. | 439/759 |
| 2,470,104 | 5/1949 | Martin | 173/259 |
| 2,860,320 | 11/1958 | Goodnight | 339/239 |
| 3,662,322 | 5/1972 | Morrison | 339/95 B |
| 3,678,450 | 7/1972 | Azamber et al. | 339/226 |
| 4,342,497 | 8/1982 | Morrison | 439/759 |
| 4,470,654 | 9/1984 | Friedman | 439/759 |
| 4,778,408 | 10/1988 | Morrison | 439/759 |

*Primary Examiner*—Paula A. Bradley

*Attorney, Agent, or Firm*—Hubbard, Thurman, Turner, Tucker & Harris

[57] ABSTRACT

An electrical clamp suitable for use with automotive jumper cables, which consists of a handle with a spring loaded conducting member extending therethrough, the conducting member preferably having two contact surfaces on the end extending from the handle. One end of the handle is open for allowing the entry of an electrical cable for attachment to the conducting member, and the other end of the handle constitutes a bearing surface facing the contact surfaces of the conducting member. One of the contact surfaces is specially adapted to be used with side-mounted battery terminals, and the other contact surface is adapted to be used with top-mounted battery terminals.

14 Claims, 1 Drawing Sheet

ELECTRICAL CLAMP

BACKGROUND OF THE INVENTION

1. Field

This invention relates to electrical clamps and, more particularly, electrical clamps suitable for use with jumper cables for attachment to automotive batteries.

2. Description of the Prior Art

One of the most common incapacitating maladies affecting automobiles is the occurrence of a dead battery. While this condition frequently requires replacement of the automobile's battery, the most immediate solution is to start the automobile with the aid of a second car's fully charged battery, the charged battery being connected to the dead battery by means of jumper cables.

Typically, jumper cables consist of a pair of insulated electrical cables with a conductive clamp secured to each end. Electrical clamps utilized for this purpose usually consists of spring loaded alligator type clamps having a pair of jaws which open when the two handles are squeezed together and close when the handles are released.

For many years automotive batteries contained two terminals, one positive and one negative, which consisted of two relatively large conductive posts extending from the top of the battery; such posts are referred to herein as "top-mounted" posts or terminals. These "top-mounted" posts or terminals are generally connected to a car's electrical system by means of conventional battery clamps which substantially surround the terminals, leaving only the top exposed. Jumper cable clamps should be large enough to grasp the battery clamps surrounding the top-mounted terminals, so that the battery clamps need not be removed to jump start the car.

In recent years, however, it has become quite common for automotive batteries to have the posts extending from the side, or "side-mounted" terminals. In most, if not all, cases, side-mounted terminals are considerably smaller than top-mounted terminals and do not require the use of conventional battery clamps for connection to a car's electrical system. These small, side-mounted terminals are, therefore, difficult to grasp with the relatively large jaws of conventional jumper cable clamps.

The problem with conventional jumper cable clamps, caused primarily by the mismatched sizes of the jaws and the terminals, is exascerbated by the typically bulky handles used on the clamps and the angle of engagement. Due to the efficient packaging of most modern engine compartments, there is seldom sufficient room to attach the front portion of a jumper cable clamp to a side-mounted terminal. Consequently, rather than approaching the terminal directly from the side of the battery, the user must approach the terminal from the top of the battery and grasp the terminal with the side of the clamp's jaws. This is frequently a difficult task, given limitations in working space and vision, especially if the task is attempted in the dark. Furthermore, since the cables naturally tend to pull on the extreme end of one handle, the affected handle will frequently rest against the battery case as a fulcrum and pry the jaws off of the terminal. In short, conventional jumper cable clamps are difficult to secure to side-mounted battery terminals and, once secured, frequently disengage themselves accidentally.

In consideration of the problems outlined above, it is an object of the present invention to provide an electrical clamp suitable for use with automotive jumper cables and adapted to accommodate side-mounted battery terminals, and preferably either side-mounted or top-mounted terminals. It is a further object of this invention to provide an electrical clamp which can be simply and quickly connected to, and disconnected from, an automotive battery, requiring the use of only one hand and no additional tools.

SUMMARY OF THE INVENTION

In accordance with the preferred embodiment disclosed in detail below, the present invention provides an improved electrical clamp for use with jumper cables, being especially adapted for use with either top-mounted or side-mounted battery terminals. The improved clamp of this invention includes a non-conductive, generally tubular handle, with a conducting member extending therethrough. An electrical cable may be introduced through an open end of the handle and connected to one end of the conducting member. The other end of the conducting member includes a flattened portion protruding through the opposite end of the handle. The flattened portion has a hole formed therein, suitable for engaging a side-mounted battery terminal, and a contact jaw extending at a right angle from its distal edge, the jaw being suitable for engaging a top-mounted battery terminal. The front end of the handle is adapted to provide a bearing surface which will cooperate with both the hole and the jaw to forcibly grasp side-mounted and top-mounted battery terminals, respectively.

The handle and conducting member are spring loaded so that the terminal grasping portions are normally biased in a relatively closed position. When the handle is pulled longitudinally outwardly from the conducting member, the bearing surface slides back with the handle, thus exposing the hole for side-mounted terminals and providing adequate room for the jaw to engage top-mounted terminals. When the handle is released, the spring attempts to return the handle to its normal position, thus forcing the bearing surface against the terminal and engaging the terminal either within the hole or against the jaw, as appropriate.

BRIEF DESCRIPTION OF THE DRAWINGS

Other objects and features of the invention will become more readily apparent from the following detailed description when read in conjunction with the accompanying drawings, in which.

DETAILED DESCRIPTION

Figure 1:
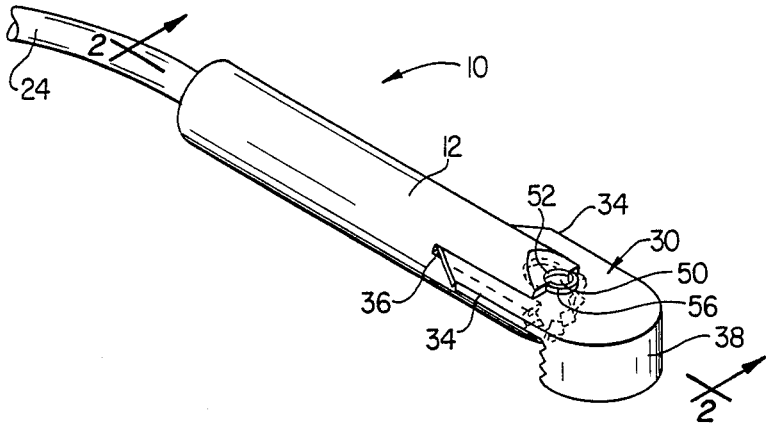
FIG. 1 is an isometric perspective view of the preferred embodiment of the present invention.
Figure 2:
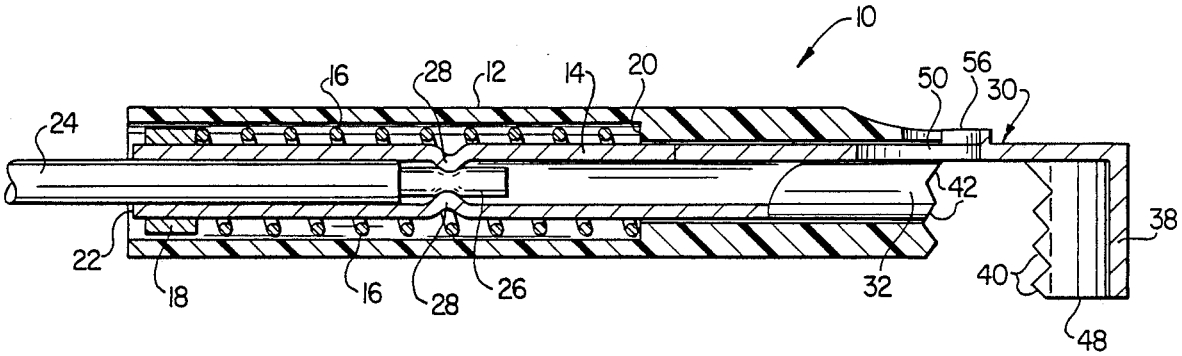
FIG. 2 is a cross-sectional view taken along line 2—2 of FIG. 1.

Referring now primarily to FIGS. 1 and 2, the preferred embodiment of the electrical clamp of the present invention is identified generally by the numeral 10. Clamp 10 consists essentially of handle 12, conducting member 14, and spring 16. The interrelationship of these elements is clearly illustrated in FIG. 2, which shows that spring 16 is disposed within handle 12 and surrounds a substantial portion of conducting member 14. Spring 16, being a conventional coiled compression spring, is maintained in position by means of retaining ring 18 and retaining wall 20, retaining ring 18 being secured to the trailing end 22 of conducting member 14 by conventional means. Inserted into trailing end 22 of conducting member 14 is electrical cable 24, with uninsulated end 26 being conventionally secured to conducting member 14 by crimping at 28. It will be understood that other methods of connecting cable 24 to conducting member 14 may be equally effective for purposes of this invention, including those methods wherein it is unnecessary to remove a portion of the insulation from cable 24.

Figure 3:
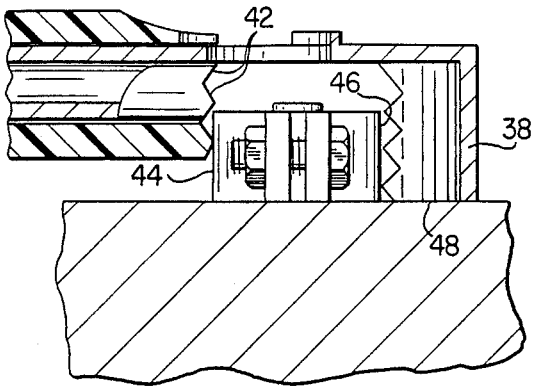
FIG. 3 is an cross-sectional view of an end portion of the present invention, depicting the operation of the clamp on a top-mounted battery terminal.

The leading end of conducting member 14 includes flat portion 30 which extends through the open end 32 of handle 12, with side flanges 34 being disposed within slots 36. Extending transversely from the distal edge of flat portion 30 is contact jaw 38, a generally arcuate extension having serrated edges 40 formed thereon and protruding towards handle 12. Open end 32 of handle 12 also contains serrated edges 42 which make up a suitable bearing surface working in cooperation with contact jaw 38 to securely engage a battery terminal, as best illustrated in FIG. 3. Serrated edges 40 and 42 operate to securely engage battery terminal 44 to reduce the likelihood that electrical clamp 10 will accidentally slip off during use. Serrated edges 40 also served to improve the electrical connection effected by clamp 10 by penetrating the surface of terminal 44, which is likely to be covered with a substantially non-conductive coating of corrosion, oxidation, or the like.

FIG. 3 illustrates the typical configuration for the attachment of electrical clamp 10 to a top-mounted battery terminal. The user of electrical clamp 10 can quickly secure the device to battery terminal 44, as shown, by hooking the last one or two serrated edges 40 of contact jaw 38 over top edge 46 of battery terminal 44, pulling back on handle 12 to separate open end 32 and serrated edges 42 from contact jaw 38 to allow battery terminal 44 to be received therebetween, pushing the handle 12 downwardly until the lower edge 48 of jaw 38 is substantially adjacent the top surface of the battery, then releasing handle 12 to allow spring 16 to drive serrated edges 42 into the portion of battery terminal 44 opposite from contact jaw 38. The constant tension exerted by spring 16, working in cooperation with jaw 38 and serrated edges 42, insures that electrical clamp 10 will remain in position during use.

Figure 4:
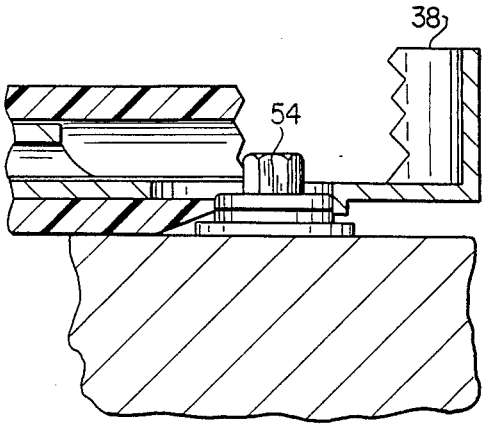
FIG. 4 is a cross-sectional view of an end portion of the present invention, depicting the operation of the clamp on a side-mounted battery terminal.

Flat portion 30 of conducting member 14 also includes hole 50 formed therein for receiving a side-mounted battery terminal, as illustrated in FIG. 4. The upper edge 52 of open end 32 of handle 12 is formed in a semi-circular configuration to provide a suitable bearing surface for gripping side-mounted terminal 54. In order to facilitate the attachment of clamp 10 to terminal 54, the edge of hole 50 facing upper edge 52 includes contact lip 56 protruding therefrom. It will be clear to those skilled in the art that the assembly depicted in FIG. 4 is accomplished in a manner similar to that set forth above for the assembly shown in FIG. 3.

The materials of construction are not critical for achieving the objectives of the present invention. In general, however, handle 12 should be constructed of a suitably ridged, non-conducting material, such as any number of available plastics. Conducting member 14, including flat portion 30 and contact jaw 38 are preferably formed of copper, but it is expected that other conductive materials would suffice. Finally, spring 16 is preferably a conventional steel compression spring, but anything suitable for maintaining the necessary force will suffice.

When assembled as disclosed herein, electrical clamp 10 constitutes a much more compact and efficient apparatus than conventional jumper cable clamps. Since the predominant direction of movement required in connecting clamp 10 to a battery terminal is longitudinal, clamp 10 may be utilized in tighter quarters than conventional jumper cable clamps. This is a significant advantage, especially when used with side-mounted terminals since there is frequently very little room available for side-to-side movement. Electrical clamp 10 offers positive engagement of both side-mounted and top-mounted terminals with relatively simple, one handed operation.

While the principles of having a conducting member adapted for connection to top-mounted and side-mounted terminals and slidably disposed within a handle has been made clear, it will be immediately apparent to those skilled in the art that there are many possible modifications to the disclosed arrangement without departing from the basic spirit of the present invention. Accordingly, the following claims are intended to cover and embrace not only the specific embodiment disclosed herein, but also such modifications within the spirit and scope of this invention.

What is claimed is:

1. An electrical clamp for releasably securing an electrical cable to a battery terminal, comprising:

a handle;

a conducting member slidably engaged with said handle, having a first end operatively securable to an electrical cable, and a second end extending from said handle;

a contact surface disposed at said second end of said conducting member, said contact surface facing said handle and being operative to engage a first portion of a battery terminal;

spring means, operatively engaging said handle and said conducting member, for resisting the longitudinally outward movement of said conducting member relative to said handle; and a bearing surface for engaging a second portion of said battery terminal, said bearing surface opposing said contact surface and being moveable with said handle.

2. An electrical clamp according to claim 1, wherein: said spring means comprises a coiled compression spring.

3. An electrical clamp according to claim 1, wherein: said contact surface and said bearing surface are adapted to receive a side-mounted automotive battery terminal

4. An electrical clamp according to claim 1, wherein: said contact surface and said bearing surface are adapted to receive a top-mounted automotive battery terminal.

5. An electrical clamp according to claim 1, wherein: said handle comprises a non-conductive, generally tubular sleeve, and said conducting member is disposed within said handle such that said contact surface faces a first end of said handle.

6. An electrical clamp according to claim 5 wherein:

a portion of said first end of said handle comprises said bearing surface.

7. An electrical clamp according to claim 1 wherein:

said conducting member comprises a tubular bar, said first end being suitable for receiving an electrical cable, and said second end having a hole formed therein, a portion of the periphery of said hole comprising said contact surface.

8. An electrical clamp according to claim 7, wherein:

said handle comprises a non-conductive, generally tubular sleeve;

said second end of said conducting member is substantially flat, said handle including suitable slots for receiving a portion of said second flat end; and an end portion of said handle partially covers said hole and comprises said bearing surface.

9. An electrical clamp according to claim 8, wherein:

said second flat end of said conducting member includes an upstanding contact lip formed around a portion of said hole, and said contact surface further comprises said contact lip.

10. An electrical clamp comprising:

a non-conductive, generally tubular handle, a first end thereof comprising a bearing surface;

a conducting member slidably mounted in said handle, said conducting member having a first open end suitable for receiving an electrical cable, and a second end protruding from said first end of said handle, said second end of said conducting member having a flat top surface;

said flat top surface having a contact hole formed therein and a downwardly depending contact jaw extending therefrom; and spring means, operatively disposed within said handle, for resisting the longitudinally outward movement of said conducting member relative to said handle; wherein either said contact hole or said contact jaw, acting in cooperation with said bearing surface, may be operatively employed to receive and engage a battery terminal.

11. An electrical clamp according to claim 10, further comprising:

a contact lip, contiguous with said flat top surface and extending upwardly from a portion of the periphery of said contact hole.

12. An electrical clamp according to claim 10, wherein:

said spring means comprises a coiled compression spring.

13. An electrical clamp according to claim 10, wherein:

said contact hole is adapted to receive a side-mounted automotive battery terminal.

14. An electrical clamp according to claim 10, wherein:

said contact jaw is adapted to receive a top-mounted automotive battery terminal.

* * * * *